United States Patent [19]

Kato

[11] 4,228,646

[45] Oct. 21, 1980

[54] ELECTRONIC TIMEPIECE WITH INDICATION DISK FOR INTERNAL STATE OF TIMEPIECE

[75] Inventor: Yoshiaki Kato, Higashimurayama, Japan

[73] Assignee: Citizen Watch Co., Ltd., Tokyo, Japan

[21] Appl. No.: 935,977

[22] Filed: Aug. 22, 1978

[30] Foreign Application Priority Data

Aug. 22, 1977 [JP] Japan ..... 52/100328

[51] Int. Cl.[3] ..... G04C 3/00

[52] U.S. Cl. ..... 368/66; 368/80; 368/204

[58] Field of Search ..... 58/23 BA, 23 D, 152 H, 58/128, 126 B; 340/636, 663, 691

[56] References Cited

U.S. PATENT DOCUMENTS 4,129,981 12/1978 Nomura et al. ..... 58/23 D

*Primary Examiner*—Vit W. Miska

*Attorney, Agent, or Firm*—Holman & Stern

[57] ABSTRACT

An electronic timepiece having time indicating hands driven by a stepping motor, means for detecting an internal condition such as battery voltage, pulse generating means for generating one or more pulses which are added to the time unit signal pulses applied to the stepping motor if the detected condition changes, and an indication disk which is periodically rotated by the stepping motor and which displays a pattern through a viewing aperture which varies depending upon whether additional pulses have been applied to the stepping motor or not.

18 Claims, 7 Drawing Figures

WAVE FORM SHAPING CIRCUIT 16
DRIVE CIRCUIT 18
ADDITION PULSE GENERATION CIRCUIT 31
TIMEKEEPING CIRCUIT 12
SUBTRACTION PULSE GENERATOR 34
VOLTAGE SAMPLING CIRCUIT 74
BATTERY VOLTAGE DETECTION CIRCUIT 38
OSC
32768Hz
128Hz
1Hz
FF1-8
FF9-15
1/30
1/2
1/6
R
110
36

EXAMPLE OF CIRCUITRY FOR EACH OF SELECTOR PULSE GENERATION CIRCUIT 66, 70, 84 AND 85

0
15
30sec
Q4
Q4
Q3(32/3 Hz)
Q2(64/3 Hz)
Q1 (64 Hz)
Q1 (64Hz)
Q (FF9)
P1
X1
P2
X2
X3
X4
P3 or P4

ELECTRONIC TIMEPIECE WITH INDICATION DISK FOR INTERNAL STATE OF TIMEPIECE

This invention relates to electronic timepieces in which time is displayed by means of at least an hours hand and a minutes hand which are driven by a stepping motor, and in particular to a method whereby an internal condition of the timepiece such as a low level of battery voltage may be notified to the user.

There have been various methods proposed whereby one or more internal conditions of an analog type timepiece can be indicated to the timepiece user. One of these methods, which is applicable to an analog type timepiece having a seconds hand, utilizes the mode of movement of the seconds hand to indicate whether the battery voltage level of the timepiece is above or below a predetermined level, to provide an indication to the user of the approach of the end of battery life. In this method, the seconds hand is advanced by two steps for every two seconds of elapsed time to indicate an excessively low level of battery voltage, as opposed to the normal movement of the seconds hand, i.e. one step per second. Such a method is not, however, applicable to an electronic timepiece having only an hours and minutes hand, since the time intervals between each step of the minutes hand would be too long to provide an effective warning to the user, if for example, the minutes hand were advanced twice every two minutes when the battery voltage dropped below a predetermined level. Such a method would also result in an error of as much as one minute appearing in the displayed time.

In another proposed method, a disk is attached to the rotor of the stepping motor of the timepiece, and colored areas of the disk are made visible to the user. A warning indication is given by rotating the disk with different periods of rotation. Such a method however presents disadvantages, such as the increased moment of inertia of the combined stepping motor rotor and disk, thereby increasing the current drawn by the stepping motor. In addition, the rotor of the stepping motor is usually of extremely small diameter and is situated deep within the body of the timepiece, making such a method difficult to implement.

With an electronic timepiece in accordance with the present invention, the disadvantages of such prior methods are eliminated, and an internal condition of an analog timepiece having at least hours and minutes hands can be clearly indicated. This is done by means of a disk which is rotated by one of the gearwheels in the gear train which drives the timepiece hands. This disk is periodically rotated and held stationary at one or more fixed angular positions, with the periods during which the disk is held stationary being considerably longer than the periods during which the disk is rotated. Individual indication patterns, such as colored sectors or characters, are applied to a surface of the disk, and a part of this surface is made visible to the user by means of a window or viewing aperture. During normal operation of the timepiece, one pattern appears in the viewing aperture, and seems to be stationary, due to the ripidity of rotation of the disk. When a change in some operating condition such as a drop in battery voltage below a certain level is detected, then a burst of pulses is applied to the drive ciruit of the stepping motor. This causes the positions in which the indication disk is held stationary below the viewing aperture to be changed, so that a different pattern becomes visible to the timepiece user.

The minutes hand of the timepiece is also advanced, but by a relatively small amount.

Subsequently, if the timepiece recovers to its original condition, then this is detected and a signal is generated which serves to inhibit a fixed number of time unit pulses from being applied to the drive circuit of the stepping motor. This number of pulses is equal to the number of pulses in the pulse burst mentioned above. Thus, the original pattern once more becomes visible to the timepiece user in the viewing aperture.

Since the indication disk is driven by the stepping motor through reduction gearing, the additional moment of inertia appearing at the rotor of the stepping motor due to the indication disk is small, being equal to the moment of inertia of the indication disk multiplied by the inverse of the square of the reduction ratio. Thus, the method of the present invention results in virtually no increase in the power consumption of the timepiece stepping motor.

It is therefore an object of the present invention to provide an improved means of displaying an internal state of an electronic timepiece of analog type.

More particularly, it is an object of the present invention to provide an improved means of displaying an internal state of an electronic timepiece of analog type whereby an indicating member such as a disk with indication patterns appearing thereon is caused to be periodically rotated halted, so that one or more of said patterns are selectively displayed in accordance with said internal state of said electronic timepiece.

These and further objects, features and advantages of the present invention will be more apparent from the following description in conjunction with the following drawings, in which.

Figure 1:
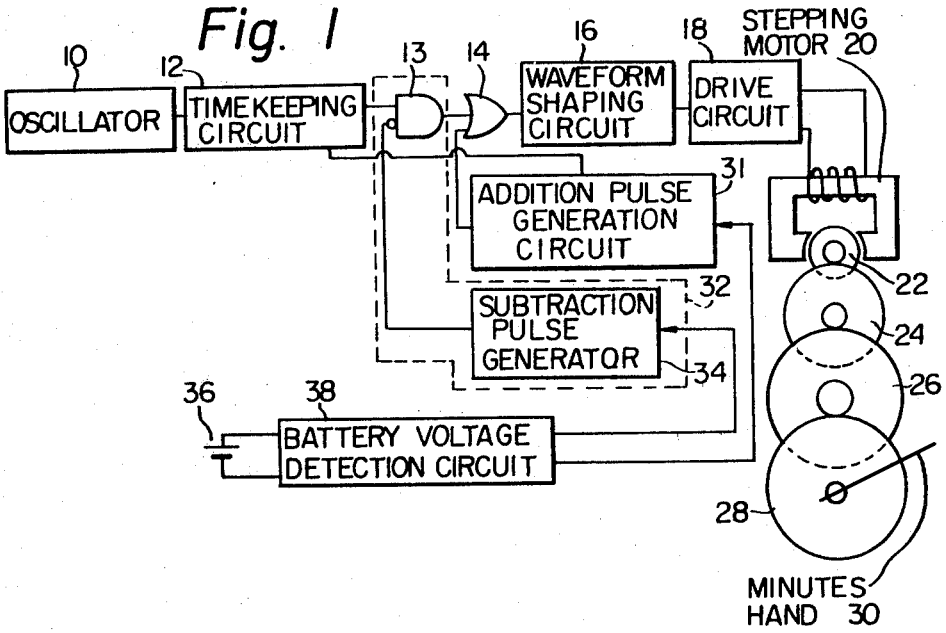
FIG. 1 is a block diagram showing the circuit and gear train of a preferred embodiment of an electronic timepiece in accordance with the present invention.

Referring now to FIG. 1, a general block diagram is shown therein of a preferred embodiment of an electronic timepiece according to the present invention. An oscillator circuit 10 supplies a relatively high frequency standard time base signal to a timekeeping circuit 12. Timekeeping circuit 12 generates a time unit signal, consisting of groups of six consecutive pulses which are produced once in every 30 seconds. This time unit signal is applied through AND gate 13 and OR gate 14, whose functions will be described later, to a waveform shaping circuit 16. Waveform shaping circuit 16 converts the time unit signal to a series of pulses of alternating polarity which are applied to a drive circuit 18. Drive circuit 18 performs amplification of the pulses from waveform shaping circuit 16 and applies these pulses to the drive coil of a stepping motor 20. The rotor 22 of stepping motor 20 rotates through 360° for every two pulses applied to the drive coil. A pinion on rotor 22 of stepping motor 20 is coupled to a gear wheel and pinion 24, with the speed reduction ratio between rotor 22 and the shaft of gear wheel and pinion 24 being 1:6. Gear wheel and pinion 24 are mounted on a shaft which also has an indication disk, to be described later, mounted thereon. This indication disk is positioned immediately below the dial plate of the timepiece. Wheel and pinion 24 are coupled to gear wheel and pinion 26, with a reduction ratio between them of 1:10. Gearwheel and pinion 26 are coupled to gearwheel 28, with a reduction ratio between them of 1:6. The minutes hand 30 of the timepiece is mounted on the shaft of gearwheel 28.

Numeral 36 indicates a battery which powers the timepiece. The voltage of battery 36 is monitored by a voltage detection circuit 38, which serves as a circuit for detecting the internal state of the timepiece such as a battery voltage as previously noted. The output terminal of voltage detection circuit 38 is coupled to the input of addition pulse generation circuit 31, the output of which is applied to one input of OR gate 14. Auxiliary timing pulses are applied from timekeeping circuit 12 to another input of pulse addition signal generation circuit 31. Output pulses from pulse addition signal generation circuit 31 are added to the pulses of the time unit signal, in OR gate 14.

Figure 2:
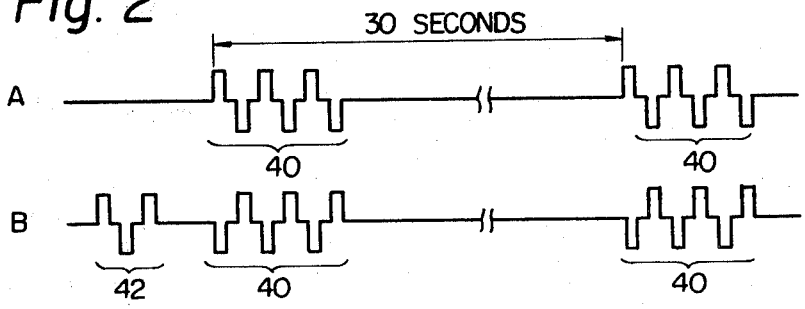
FIG. 2 is a waveform diagram showing drive pulses applied to the stepping motor shown in FIG. 1.

Referring now to FIG. 2, the waveforms of the drive pulses applied to the drive coil of stepping motor 20 are shown at FIG. 2A for the case of the battery voltage being above a level which is determined by voltage detection circuit 38, and for the case of the battery voltage being below that predetermined level, at FIG. 2B. As shown at FIG. 2A, a group of six consecutive pulses of alternating polarity are applied to the drive coil of stepping motor 20 once in every 30 seconds. Since, as stated above, rotor 22 of stepping motor 20 is rotated through 360° for every two consecutive pulses applied to its drive coil, it will be apparent that rotor 22 will perform three complete rotations every 30 seconds. Since the speed ratio between prior rotor pinion 22 and gear wheel and pinion 24 is 1:6, gear wheel and pinion 24 will rotate through 180°, i.e. one half revolution, once in every 30 seconds. The duration of each of the groups of six consecutive pulses 40 shown in FIG. 2 is extremely short by comparison with the time interval between each group. For example, if each pulse has a duration of 7 ms, with a 7 ms space between each pulse, then the duration of each pulse group will be 77 ms, while the period from the start of one pulse group 42 to the start of the next group is 30 seconds. Thus, the indication disk attached to the shaft wheel and pinion 24 will be rotated extremely rapidly (i.e. in 77 ms) through ½ revolution once in every 30 seconds, and then remain stationary until the next pulse group 42 is applied to the stepping motor coil whereupon the disk will be rotated through a further ½ revolution, and so on. Since the speed reduction between the gearwheel 28 which carries minutes hand 30 and rotor 22 is 1:360, minutes hand 30 will be advanced by $3\times360°/360$, i.e. by 3°, once in every 30 seconds. In other words, the minutes hand is advanced in intermittent steps, at a rate of two steps per minute.

Figure 3:
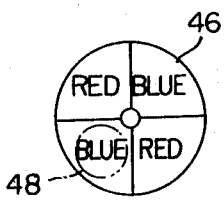
FIG. 3 is a diagram showing an example of an indication disk for the embodiment of the present invention shown in FIG. 1.

FIG. 3 shows an example of a rotatable display indicia serving as an indication disk suitable for the embodiment of the present invention shown in FIG. 1. The surface of one side of indication disk 46 is divided into 4 equal sectors, which are colored alternately red and blue. The disk is situated immediately beneath the dial plate of the timepiece, in which a viewing aperture 48 is provided, as indicated by the phantom line in FIG. 3. When the battery voltage is at a normal level, then the blue sectors of disk 46 alternately are rotated to be held stationary beneath viewing aperture 48, due to disk 46 being repeatedly rotated through 180° by the action of pulse groups 40, as described above. Since the time periods during which indication disk 46 actually rotates are extremely short, it appears to the user as if a blue sector were continuously held stationary beneath the viewing aperture 48.

If, now, the voltage of battery 36 falls below a predetermined level, due for example to the battery approaching the end of its useful life, this is detected by voltage detection circuit 38. Voltage detection circuit 38 therefore produces a detection signal which is applied to pulse addition signal generation circuit 31, which selects three consecutive pulses of an auxiliary timing signal which is input to it from timekeeping circuit 12. These three pulses are added to the time unit signal in OR gate 14, and the combined signal, which constitutes the drive input signal, is applied to the drive coil of stepping motor 20 through waveform shaping circuit 16 and drive circuit 18. The waveform of the signal applied to the drive coil is as shown at FIG. 2B. Due to the action of the additional three consecutive alternating pulses 42 applied to the drive coil, the rotor 22 of stepping motor 20 is rotated through 1½ revolution, i.e. through 540°. Indication disk 46 is therefore rotated through 90°, thereby causing one of the red sectors on the disk to appear beneath viewing aperture 48. Subsequently, each time indication disk 46 is rotated through 180° by each of pulse groups 40, a red sector will appear beneath viewing aperture 48. It will therefore appear to the timepiece user that a red sector is virtually stationary beneath the viewing aperture. This provides a warning indication to the user that the battery voltage has reached a level at which battery replacement will be necessary.

Figure 4:
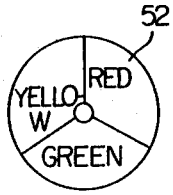
FIG. 4 is a diagram showing another example of an indication disk for an electronic timepiece in accordance with the present invention, having three colored sectors appearing thereon.

FIG. 4 shows another example of an indication disk for an electronic timepiece in accordance with the present invention, having in this case three equal sectors on its surface of different colors. Such a disk can be used to provide a two-level warning signal, for example to first indicate to the user that the battery voltage has fallen to a level at which battery replacement is becoming necessary, and to subsequently indicate that immediate battery replacement is necessary, when the battery voltage falls below a second level. If such a disk is used, it will be necessary to add a group of pulses to the drive signal of the stepping motor such as to rotate the disk through 120°, each time a battery voltage level transition is detected.

It is also possible to provide means for cancelling a warning signal after it has been generated. This may be necessary in the case of a battery life warning system, for example. If the timepiece is temporarily left by the user in a cold room for some period of time, then the rise in internal resistance of the battery caused by the low ambient temperature may cause the terminal voltage of the battery to fall below the level at which a detection signal is generated by voltage detection circuit 38. Subsequently, when the timepiece is brought into a warmer operating environment, and the internal battery resistance falls so that the terminal voltage of the battery again rises above the detection level, then it is desirable to cancel the warning signal displayed by indication disk 46. This can be done as shown by the components 32 within the broken line in FIG. 1. When a transition from an excessively low battery voltage to a normal voltage is detected by voltage detection circuit 38, an output signal is generated and applied to subtraction pulse generation circuit 34. This circuit is thereby activated to apply a selector signal to an inhibit input of AND gate 13. This selector signal is applied during one of pulse groups 40, shown in FIG. 2, and extends such as to include the duration of three consecutive pulses. Thus, three pulses are effectively subtracted from the drive signal applied to stepping motor 20. Pulse indication disk 46 will therefore be rotated through only 90° by the action of the pulse group from which three pulses are subtracted. One of the blue sectors, indicating normal battery voltage will therefore once more appear beneath viewing aperture 48, i.e. the warning indicaton is cancelled. Subsequently, indication disk 46 will again be repetitively rotated through 180° by each of pulse groups 40, so that the blue sector will appear to be stationary beneath viewing aperture 48.

Figures 5, 6:
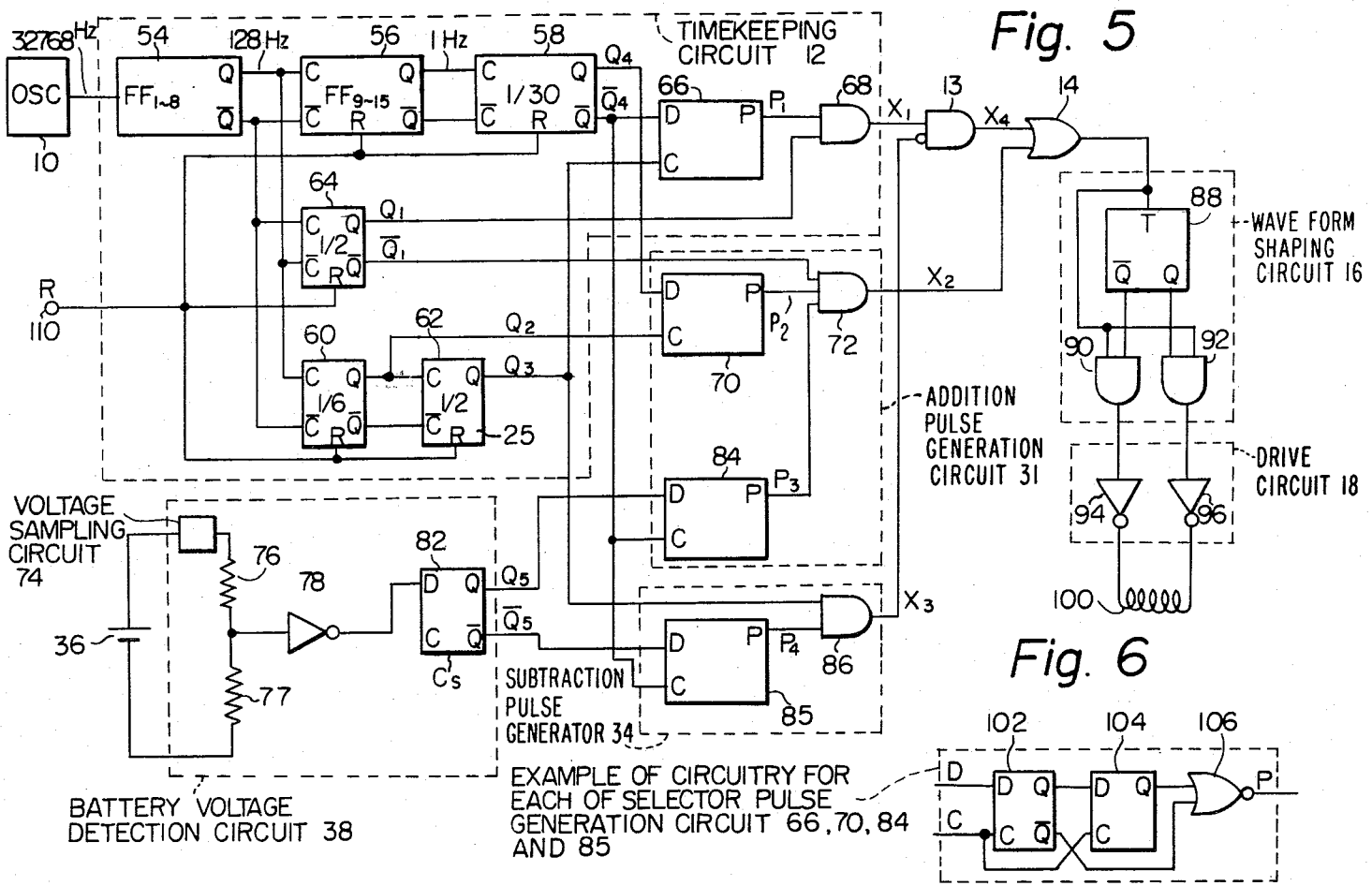
FIG. 5 is a general ciruit diagram of the electronic timepiece shown in FIG. 1.
FIG. 6 is a circuit diagram of a selector pulse generation circuit shown in FIG. 5.

FIG. 5 is a circuit diagram showing various circuit blocks indicated in FIG. 1 in more detail. Oscillator circuit 10 generates a standard frequency signal of 32768 Hz, as a time signal, which is applied to timekeeping circuit 12. Frequency divider block 54 contains 8 stages of ½ frequency division, and therefore generates an output signal of frequency 128 Hz. Both normal and inverted outputs, Q and $\overline{Q}$ are produced, respectively. The output signals from frequency divider block 54 are applied to frequency divider block 56, which comprises 7 stages of ½ frequency division and generates an output signal with a frequency of 1 Hz. The output terminals of frequency divider block 56 are connected to the clock terminals of frequency divider block 58 which is a 1/30 frequency divider, and therefore generates an output signal having a period of 30 seconds. The normal and inverted output signals from frequency divider block 58 are designated as Q4 and $\overline{Q4}$ respectively. The Q and $\overline{Q}$ output terminals of frequency divider block 54 are applied to the clock terminals of a ½ frequency divider block 64, and to a 1/6 frequency divider block 60, with the connections to the clock terminals of blocks 60 and 64 being inverted with respect to the connections to the clock terminals of frequency divider block 56. Thus, output signals Q1 and $\overline{Q1}$ from frequency divider block 64 are identical in frequency to the output of the first frequency divider stage in frequency divider block 56, but are shifted in phase by 180°. The waveforms of various signals generated in the circuits of FIG. 5 are illustrated in the waveform diagrams of FIG. 7. The Q and $\overline{Q}$ outputs of 1/6 frequency divider block 60 are applied to the clock terminals of ½ frequency divider block 62, and the output signals from blocks 60 and 62 are designated as Q2 and Q3 respectively, and have frequencies 64/3 Hz and 32/3 Hz respectively. Signal Q3 is applied to the clock terminal of a selector pulse generation circuit 66, with the inverted output $\overline{Q4}$ from frequency divider block 58 being applied to the data input terminal of selector pulse generation circuit 66. This circuit serves to generate a single selector pulse when the input signal applied to its data terminal goes from the low logic level (referred to hereinafter as the L level) to the high logic level (referred to hereinafter as the H level), with the duration of this selector pulse being equal to the period of the signal applied to the clock input terminal of the selector pulse generation circuit. Circuit blocks 70, 84 and 85 are of identical configuration to circuit block 66.

A suitable configuration for each of these selector pulse generation circuits is shown in FIG. 6. This is a circuit configuration which is well known. It will be apparent that the output from NOR gate 106 will normally be at the L level, due to at least one of the inputs to this NOR gate being at the H level. When the input signal applied to the data terminal (D) of flip-flop 102 goes from the L level to the H level, and thereafter remains at the H level, then both the $\overline{Q}$ terminal of flip-flop 102 and the Q terminal of flip-flop 104 will go to the L level and remain at that level during one cycle of the clock signal (C) applied to the clock terminal of flip-flops 102 and 104. Thus, the output of NOR gate 106 will remain at the H level during one cycle of the clock signal, and will thereafter remain at the L level until another transition of the data input signal signal from the L level to the H level occurs.

Figure 7:
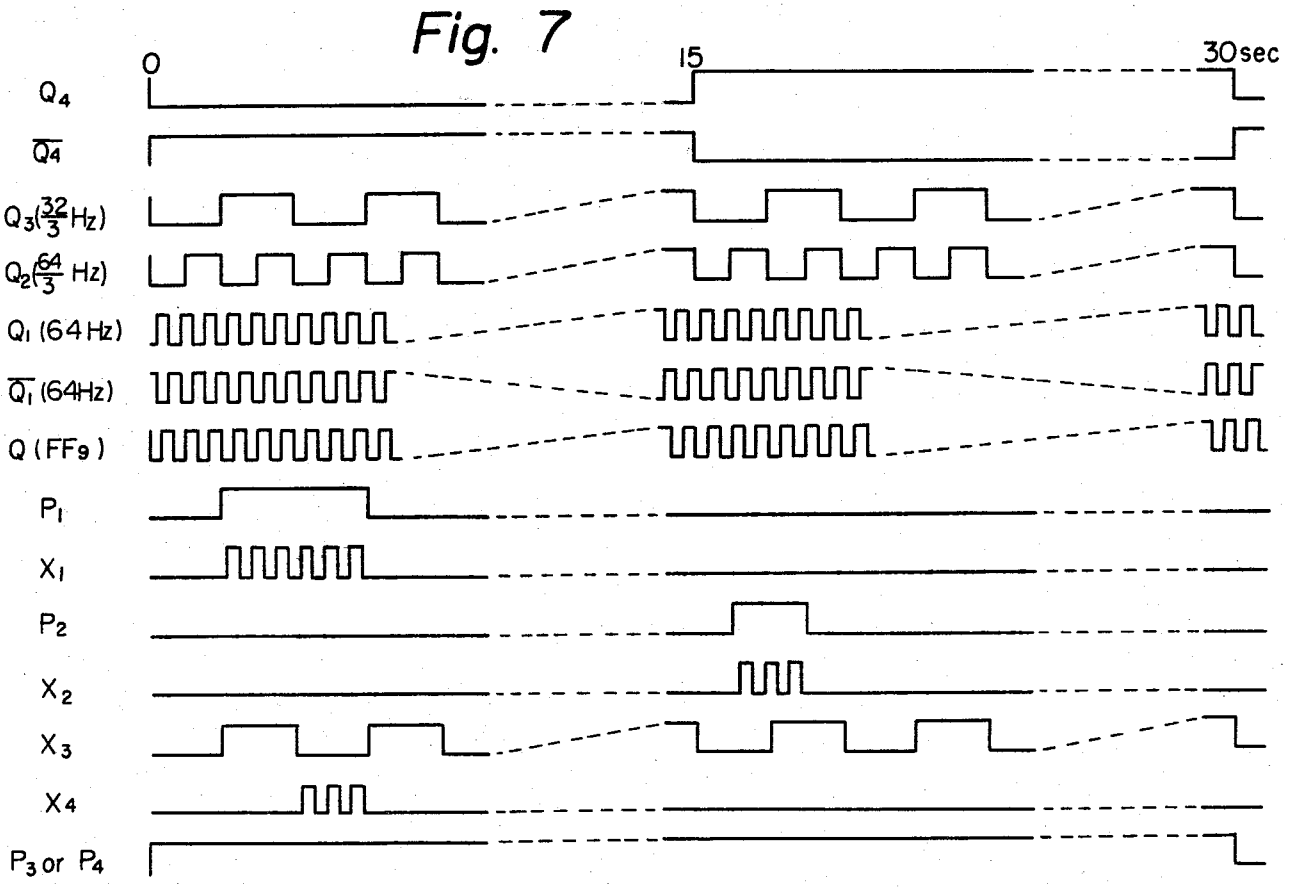
FIG. 7 is a waveform diagram for the circuit shown in FIG. 5

Thus, as a result of signal $\overline{Q4}$ applied to the data terminal of selector pulse generation circuit 66, and signal Q3 applied to the clock terminal of circuit 66, selector signal P1 is generated as a single pulse with duration equal to the period of signal Q3, after signal $\overline{Q4}$ goes from the L level to the H level. This is shown in FIG. 7. Signal P1 is applied to one input terminal of AND gate 68, with signal Q1 being applied to the other input terminal. Since the duration of selector pulse P1 is 3/64 seconds, while the period of signal Q1 is 1/64 seconds, it will be apparent that three cycles of signal Q1 are contained in selector pulse P1. Due to the inversion of the connections between the output terminals of frequency divider block 54 and the clock terminals of frequency divider blocks 60 and 64, the phase of signal Q1 is such that six complete pulses of signal Q1 are overlapped by signal P1. Thus, six successive pulses of signal Q1 are gated through AND gate 68 by means of each P1 selector pulse. The output from AND gate 68 is the time unit signal, and is designated as signal X1. It is applied to an input of AND gate 13. During normal operation, signal X1 passes through AND gate 13 without being changed, to be applied as signal X4 to OR gate 14. The output signal from OR gate 14 is applied to waveform shaping circuit 16. Thus, a group of six pulses is input to waveform shaping circuit 16 every 30 seconds. Waveform shaping circuit 16 contains a toggle-type flip-flop 88, with the Q and $\overline{Q}$ outputs of this flip-flop being connected to input terminals of AND gates 92 and 90 respectively. The output of OR gate 14 is applied to the other input terminals of AND gates 92 and 90. Each time a pulse is applied to waveform shaping circuit 16 from OR gate 14, the outputs of toggle-type flip-flop 88 are reversed in logic level, so that input pulses from OR gate 14 are alternately gated through AND gates 90 and 92. The outputs from AND gates 90 and 92 are applied to drive amplifiers 94 and 96 respectively in drive circuit 18. The output terminals of amplifiers 94 and 96 are connected to opposite ends of drive coil 100 of stepping motor 21, so that drive pulses of alternating polarity are applied to drive coil 100, as indicated in the waveform diagrams of FIG. 2.

The method by which drive pulses are added or subtracted, in order to generate or cancel a warning indication, will now be described. Numeral 74 indicates a voltage sampling circuit which is connected between one terminal of battery 36 and a voltage divider composed of two resistors 76 and 77 connected in series, in voltage detection circuit 38. Sampling circuit 74 periodically applies the voltage of battery 36 to the voltage divider for an extremely short period of time. Thus, the average current drawn through resistors 76 and 77 is very low. The values of resistors 76 and 77 are adjusted such that, when the battery voltage has almost reached a predetermined level (representing almost the end of the useful battery life), the voltage developed across resistor 77 when the battery voltage is sampled by sampling circuit 74, is only just the threshold voltage of inverter 78. Thus, the output of inverter 78, which is usually at the H level, goes to the L level when sampling occurs, in this case. The output of inverter 78 is connected to the data terminal of data-type flip-flop 82. Clock pulse $C_S$ is applied to the clock terminal of flip-flop 82 while the battery voltage is being sampled. Thus, if the voltage across resistor 77 is higher than the threshold voltage of inverter 78 when sampling occurs, then an L level signal is applied to the data terminal of flip-flop 82 from inverter 78. Flip-flop 82 is thereby reset, so that output $\overline{Q5}$ remains at the H level while output Q5 remains at the L level. If, now, the battery voltage falls below the predetermined minimum level, indicating the end of battery life, then the voltage developed across resistor 77 when sampling is performed by sampling circuit 74 is below the threshold level of inverter 78. An H level input is therefore applied to the data terminal of flip-flop 82, and output Q5 goes to the H level, i.e. flip-flop 82 is set, and output $\overline{Q5}$ goes to the L level. Output signal Q5 of flip-flop 82 is applied to the data terminal of selector pulse generation circuit 84, while signal $\overline{Q4}$ from 1/30 frequency divider block 58 is applied to the clock terminal of circuit 84 as an auxiliary timing signal. Thus, when the battery voltage falls below the predetermined level so that a transition from the L level to the H level occurs at the data terminal of selector pulse generation circuit 84. The clock terminal of this circuit is connected to signal $\overline{Q4}$ from 1/30 frequency divider block 58. Thus, a single selection pulse P3 is produced by selector pulse generation circuit 84, which has a pulse width equal to the period of signal $\overline{Q4}$, i.e. 30 seconds. Selector pulse P3 is applied to one input of AND gate 72. Output signal Q2 from frequency divider block 60, which has a period of 3/64 seconds, is applied to the clock terminal of selector pulse generation circuit 70 as an auxiliary timing signal. Signal Q4, which has a period of 30 seconds, is applied to the data terminal of selector pulse generation circuit 70. Thus, as shown in FIG. 7, when signal Q4 goes from the L level to the H level, a selector pulse P2 is generated, with a duration equal to the period of signal Q2, i.e. 3/64 seconds. Selector pulse P2 is applied to an input terminal of AND gate 72, while signal $\overline{Q1}$ is applied to a third input terminal of AND gate 72. The timing of selector pulse P2 is such that three consecutive pulses of signal $\overline{Q1}$ are gated through AND gate 72 when signals P2 and P3 are both at the H level. The output of AND gate 72, is designated as signal X2. From the foregoing explanation, it will be apparent that only a single group of three consecutive pulses is output from AND gate 72 after a drop in battery voltage below the predetermined level is detected by voltage detection circuit 38, since signal P3 subsequently returns to the L level, thereby inhibiting further output of pulses from AND gate 72.

The output of AND gate 72 is applied to OR gate 14, and is thereby added to the output of AND gate 13. The latter output signal consists of discrete groups of six consecutive pulses, as described previously. The combined output from OR gate 14 is applied to the coil 100 of stepping motor 20 through waveform shaping circuit 16 and drive circuit 18, so that the single group of three consecutive pulses causes indication plate 46 to be rotated through 90°. A warning is thereby given to the timepiece user that the battery voltage is excessively low.

If the battery voltage should subsequently again rise above the predetermined minimum level, then output $\overline{Q5}$ of voltage detection circuit 38 goes from the L level to the H level. Signal $\overline{Q5}$ is applied to the data input of selector pulse generation circuit 85, while signal $\overline{Q4}$ is applied to the clock input terminal of this circuit. Thus, selector pulse P4 is output from circuit 85. This pulse has a duration equal to the period of signal $\overline{Q4}$, i.e. 30 seconds, as for selector pulse P3. Selector pulse P4 is applied to one input of AND gate 86, with signal Q3 being applied to the other input terminal of AND gate 86. Signal Q3 consists of a train of pulses with frequency 32/3 Hz, so that signal X3 which is output from AND gate 86 consists of a group of pulses with frequency 3/32 Hz and continuing for 30 seconds. As shown in FIG. 7, the phase relationships between signals X3 and X1 are such that the first pulse in the group of pulses in signal X3 overlaps the first 3 pulses of the corresponding pulse group in signal X1. Signal X3 is applied to an inhibit input terminal of AND gate 13, so that three consecutive pulses of a pulse group in signal X1 are inhibited from passing through AND gate 13. In other words, three pulses are subtracted from that pulse group of signal X1. As a result, only three drive pulses are applied to drive coil 100, during the corresponding drive pulse group, so that indication disk 46 is rotated through only 90°. The warning indication given by the indication disk is therefore cancelled, as stated in the description relating to FIG. 1.

Initialization of the circuit operation, to ensure that the correct sectors of the indication disk appear beneath the viewing aperture when the battery voltage is normal, will be necessary when a new battery is installed in the timepiece. This can be done, for example, by means of a reset terminal as indicated by numeral 110 in FIG. 5, coupled to the reset inputs of the various frequency divider blocks. If desired, this reset terminal can be controlled by a switch coupled to the crown of the timepiece.

It is possible to modify the operation of a circuit in accordance with the present invention, such that additional pulses are not supplied to the stepping motor drive coil when the voltage detection circuit detects a drop in battery voltage below the minimum level, but wherein actuation of a control switch by the timepiece user causes a control circuit to allow the additional pulses to be generated and applied to the motor. Thus, a warning indication will only appear when the timepiece user actually checks the battery voltage by actuating said control switch. With such a method, it is also possible to arrange that when the control switch is released, an equal number of pulses to the pulses which were added are subtracted from the time unit pulses applied to the drive circuit of the stepping motor. If this is done, then it is not necessary to utilize an indication disk to provide indication of the battery voltage condition. Instead, a relatively large number of pulses can be added to the time unit pulses, if the control switch is actuated after the detection circuit has detected a drop in battery voltage below the predetermined level. This will cause the minutes hand of the timepiece to rotate through a large and conspicuous angle, thereby providing a warning notification to the user of the low battery voltage. When the control switch is then released, the number of pulses which were added are subtracted from the time unit pulses, so that the minutes hand returns to indicating the correct time after a short interval has elapsed. Alternatively, it is possible to reverse the direction of rotation of the motor after the control switch is released, so as to immediately compensate for the temporary advance of the minutes hand.

Although the embodiment of the present invention described herein provides an indication of the condition of the timepiece battery, it is equally possible to apply the method of the present invention to the indication of other types of information. For example, instead of colored sectors appearing upon the indication disk, the symbols AM and PM could be provided, to thereby give an AM/PM time information indication. Indication of other information or timepiece internal conditions are also possible.

What is claimed is:

1. An electronic timepiece powered by a battery, comprising:

a standard frequency signal source for providing a standard frequency signal;

timekeeping circuit means responsive to said standard frequency signal for providing a time unit signal;

drive circuit means responsive to said time unit signal for providing first drive pulses;

a stepping motor having a drive coil coupled to said drive circuit means with a rotor of said stepping motor being rotated through a fixed angle by each of said first drive pulses;

time indicating hands driven by said stepping motor for providing a display of time information;

a rotatable display indicia normally driven by said stepping motor in a first operating mode to provide an indication of an internal state of the timepiece;

detection means for detecting a change of said internal state of the timepiece to provide a detection signal in response thereto; and circuit means for providing an input signal in response to said detection signal and said time unit signal;

said drive circuit means being responsive to said input signal for providing modulated drive pulses by which said stepping motor changes said display indicia to a second operating mode to cause said display indicia to provide an indication of said change of said internal state of the timepiece;

said rotatable display indicia being alternately rotated through a first predetermined angle and held stationary in each of a first set of angular positions when said stepping motor is driven in response to said drive pulses and rotated through a second predetermined angle due to said modulated drive pulses being applied to said stepping motor;

said display indicia comprising an indication member having a plurality of indication patterns on a surface thereof and with each of said indication patterns being situated relative to adjacent indication patterns at angular intervals corresponding to said first predetermined angle.

2. An electronic timepiece according to claim 1, wherein said detection means generates a first detection signal when a first internal state of said electronic timepiece is detected and generates a second detection signal when a second internal state of said electronic timepiece is detected.

3. An electronic timepiece according to claim 2, wherein said circuit means comprises addition pulse generation means responsive to said first detection signal for generating at least one additional pulse, and gate circuit means for adding said at least one additional pulse to said time unit signal to provide said input signal.

4. An electronic timepiece according to claim 3, wherein said timekeeping circuit provides an auxiliary timing signal comprises a first timing signal, a second timing signal and a third timing signal, with said second timing signal being of lower frequency than said first timing signal and said third timing signal being of lower frequency than said second timing signal and wherein said addition pulse generation means comprises:

first selector pulse generation circuit means for generating a first selector pulse in response to said first detection signal and to said third timing signal;

second selector pulse generation means for generating a second selector pulse in response to said second timing signal and to said third timing signal; and a logic AND gate having said first timing signal said first selector pulse and said second selector pulse applied to input terminals thereof for producing said at least one additional pulse.

5. An electronic timepiece according to claim 4, wherein said circuit means further comprises subtraction pulse generation means responsive to said second detection signal for generating a pulse to be applied to said gate means for subtracting at least one pulse from said time unit signal.

6. An electronic timepiece according to claim 5, wherein said gate means includes a first logic AND gate having said time unit signal applied to an input terminal thereof and wherein said subtraction pulse generation means comprises:

selector pulse generation means responsive to said second detection signal and to said third timing signal for generating a selector pulse; and a second logic AND gate responsive to said selector pulse and to a control signal produced from said timekeeping circuit for producing a subtraction control signal to be applied to an inhibit terminal of said first logic AND gate to subtract at least one pulse of said time unit signal.

7. An electronic timepiece according to claim 2, wherein said detection means comprises a voltage detection circuit for detecting the voltage of said battery and wherein said first detection signal is produced when the voltage of said battery is above a predetermined level and wherein said second detection signal is produced when said voltage of said battery falls below said predetermined level.

8. An electronic timepiece according to claim 1, wherein said rotatable display indicia is coupled to said stepping motor through at least one gear wheel and pinion.

9. An electronic timepiece according to claim 1, wherein said indication patterns comprise a plurality of sectors on a surface of said indication member with said sectors being of at least two different colors.

10. An electronic timepiece powered by a battery, comprising:

a standard frequency signal source for providing a standard frequency signal;

timekeeping circuit means responsive to said standard frequency signal for providing a time unit signal and at least one auxiliary timing signal;

detection means for detecting at least one internal state of said electronic timepiece to provide at least one detection signal when a change in said internal state is detected;

addition pulse generation means responsive to said auxiliary timing signal and to said detection signal for generating an output signal comprising at least one additional pulse each time said detection signal is generated;

gate means response to said output signal from said pulse generation means and to said time unit signal for combining said time unit signal with said output signal from said pulse generation means to provide a drive input signal;

drive circuit means responsive to said drive input signal means for producing drive pulses;

a stepping motor having a drive coil coupled to said drive circuit means with a rotor of said stepping motor being rotated through a fixed angle by each of said drive pulses;

a rotatable display indicia driven by said stepping motor to be thereby alternately rotated through a first predetermined angle and held stationary in each of a first set of angular positions prior to said detection signal being generated and to be thereby rotated through a second predetermined angle due to said at least one additional pulses being applied through said drive circuit to said drive coil of said stepping motor after said detection signal is generated and thereafter to be alternately rotated through said first predetermined angle and held stationary in each of a second set of angular positions; and for providing a display of time information;

said display indicia comprising an indication member having a plurality of indication patterns on a surface thereof and with each of said indication patterns being situated relative to adjacent indication patterns at angular intervals with each angular interval corresponding to said first predetermined angle.

11. An electronic timepiece according to claim 10, wherein said detection means generates a first detection signal when a first internal state of said electronic timepiece is detected and generates a second detection signal when a second internal state of said electronic timepiece is detected.

12. An electronic timepiece according to claim 11, wherein said addition pulse generation means is responsive to said first detection signal for generating said at least one additional pulse and wherein said gate circuit means serves to add said at least one additional pulse to said time unit signal.

13. An electronic timepiece according to claim 12, wherein said auxiliary timing signal comprises a first timing signal, a second timing signal and a third timing signal, with said second timing signal being of lower frequency than said first timing signal and said third timing signal being of lower frequency than said second timing signal and wherein said addition pulse generation means comprises:

first selector pulse generation circuit means for generating a first selector pulse in response to said first detection signal and to said third timing signal;

second selector pulse generation means for generating a second selector pulse in response to said second timing signal and to said third timing signal; and a logic AND gate having said first timing signal said first selector pulse and said second selector pulse applied to input terminals thereof for producing said at least one additional pulse.

14. An electronic timepiece according to claim 12, further comprising subtraction pulse generation means responsive to said second detection signal for generating a pulse to be applied to said gate means for subtracting at least one pulse from said time unit signal.

15. An electronic timepiece according to claim 14, wherein said gate means includes a first logic AND gate having said time unit signal applied to an input terminal thereof and wherein said subtraction pulse generation means comprises:

selector pulse generation means responsive to said second detection signal and to said third timing signal for generating a selector pulse; and a second logic AND gate responsive to said selector pulse and to a control signal produced from said timekeeping circuit for producing a subtraction control signal to be applied to an inhibit terminal of said first logic AND gate to subtract at least one pulse of said time unit signal.

16. An electronic timepiece according to claim 11, wherein said detection means comprises a voltage detection circuit for detecting the voltage of said battery as said at least one internal state of said electronic timepiece, and wherein said first detection signal is produced when the voltage of said battery is above a predetermined level and wherein said second detection signal is produced when said voltage of said battery falls below said predetermined level.

17. An electronic timepiece according to claim 10, wherein said rotatable display indicia is coupled to said stepping motor through at least one gear wheel and pinion.

18. An electronic timepiece according to claim 10, wherein said indication patterns comprise a plurality of sectors on a surface of said indication member with said sectors being of at least two different colors.

* * * * *